United States Patent [19]

Honda

[11] Patent Number: 4,591,025

[45] Date of Patent: May 27, 1986

[54] TRACTION TYPE ELEVATOR SYSTEM

[75] Inventor: Takenobu Honda, Inazawa, Japan

[73] Assignee: Mitsubishi Denki Kabushiki Kaisha, Tokyo, Japan

[21] Appl. No.: 652,184

[22] Filed: Sep. 19, 1984

[30] Foreign Application Priority Data

| | | | |
|---|---|---|---|
| Sep. 21, 1983 | [JP] | Japan | 58-174856 |
| Dec. 16, 1983 | [JP] | Japan | 58-237345 |
| Dec. 26, 1983 | [JP] | Japan | 58-203094[U] |

[51] Int. Cl.[4] ..... B66B 11/08

[52] U.S. Cl. ..... 187/20; 254/416; 254/902; 474/168

[58] Field of Search ..... 187/20, 22; 254/373, 254/374, 404, 412, 416, 902; 474/168, 169, 170

[56] References Cited

U.S. PATENT DOCUMENTS

| | | | |
|---|---|---|---|
| 1,098,845 | 6/1914 | Schwab | 187/20 X |
| 1,802,759 | 4/1931 | Dunlop | 187/20 |
| 3,168,287 | 2/1965 | Parola | 254/902 |
| 4,030,569 | 6/1977 | Berkovitz | 187/20 |

FOREIGN PATENT DOCUMENTS

| | | | |
|---|---|---|---|
| 0018160 | 2/1978 | Japan | 187/20 |
| 0658074 | 4/1979 | U.S.S.R. | 254/374 |

*Primary Examiner*—Joseph J. Rolla
*Assistant Examiner*—Nils E. Pedersen
*Attorney, Agent, or Firm*—Leydig, Voit & Mayer, Ltd.

[57] ABSTRACT

A main rope is wound round a sheave and a deflector wheel by three turns, and the sectional shape of those rope grooves of the sheave with which the main rope is held in engagement is formed in the shape of circular arcs, whereby the lifetimes of the main rope and the sheave are lengthened, and an enhanced traction ability is attained. Among the grooves of the driving sheave around which the main rope is wound, those except the grooves around which the main rope is wound first and last are shaped so as to afford greater friction at contact therebetween than the frictional contact of the first and last grooves, or the grooves around which the main rope is wound first and last are rendered higher in hardness than the other grooves, whereby the amounts of wear of the respective grooves are equalized to extend the lifetimes of the rope and the sheave and to prevent the pleasant ride of an elevator from worsening.

8 Claims, 15 Drawing Figures

TRACTION TYPE ELEVATOR SYSTEM

BACKGROUND OF THE INVENTION

This invention relates to a traction type elevator system.

A prior-art traction type elevator system will be described with reference to FIGS. 1 to 3.

In FIG. 1, numeral 1 designates a driving sheave, numeral 2 a deflector wheel, numeral 3 a main rope made of a wire rope which is extended over the sheave 1 and the deflector wheel 2, numeral 4 a case suspended from one end of the main rope 3, and numeral 5 a balance weight suspended from the other end of the main rope 3. In FIGS. 2 and 3, the same numerals as in FIG. 1 indicate identical or corresponding portions. In the prior-art elevator system of this type, as shown in FIG. 2, the main rope 3 is wound around the sheave 1 and the deflector wheel 2 by two turns, while as shown in FIG. 3, a rope race 6, formed in the socalled undercut groove in a sectional view thereof in which substantially rectangular recesses are joined to the bottoms of circular arcs, is formed along the outer peripheral surface of the sheave 1 so as to hold the main rope 3 in engagement with the rope race 6.

In recent years, saving energy and saving resources have also been sought after in elevators. For example, as described in the official gazette of Japanese Patent Application Laying-open No. 50-48646, miniaturizing a hoisting machine and reducing the weight of a cage have been major objects.

For realizing the above requirements, it is a precondition to enhance the traction. As is well known, the traction is expressed by $e^{\mu k2\theta}$. Also, that the following condition as specified by equation (1) must be met in order for the elevator to operate safely:

$$e^{\mu k2\theta} > (T_2/T^1 \quad (1)$$

where e: the base of the natural logarithm, $\mu$: the friction factor between the rope race of the driving sheave and the main rope, $k_2$ a coefficient depending upon the shape of the rope race, $\theta$: the winding angle of the main rope round the driving sheave, $T_1$: the tension of the main rope on the cage side, $T_2$: the tension of the main rope on the balance weight side.

Thus, the traction can be enhanced by increasing the friction factor $\mu$, the coefficient $k_2$ depending upon the shape of the rope race and the winding angle $\theta$. However, the increase of the friction factor $\mu$ spoils lubricity, and the increase of the coefficient $k_2$, which depends upon the shape of the rope race raises the surface pressure. Further, the increase of either or both of these variables is undesirable because the lifetimes of the main rope and the sheave shorten due to the wear etc. thereof. It has been, accordingly, considered, to wind the main rope, having hitherto been wound round the sheave by two turns, by three turns in order to increase the winding angle $\theta$ of the main rope round the sheave. Even this measure, however, has had the disadvantage that the lifetime of the main rope is shortened due to the increase in the number of times the main rope is bent when the sectional shape of the rope race of the sheave in the prior art is left intact.

SUMMARY OF THE INVENTION

This invention is intended to eliminate the disadvantage mentioned above, and has for its object to provide a traction type elevator system wherein a main rope is wound around a sheave and a deflector wheel by three turns, and the sectional shape of the rope race formed in the sheave which the main rope engages is formed in the shape of circular arcs, whereby the traction can be enhanced, thereby increasing the life of the main rope and the sheave.

Further, this invention has for its object to provide a traction type elevator system wherein among individual sheave grooves which engage a rope wound by three turns, the first and third grooves are rendered higher in hardness than the second groove, whereby the amounts of wear of the respective grooves are equalized so as to lengthen the life of the rope and the sheave and to maintain a pleasant ride provided by the elevator.

Still further, this invention has for its object to provide a traction type elevator system wherein among the grooves of a driving sheave around which a main rope is wound, the grooves other than those around which the main rope is wound first and last are shaped so as to impart larger amounts of friction to the main rope than the amounts of friction that the first and last grooves impart, whereby the amounts of wear of the grooves of the driving sheave can be equalized.

PREFERRED EMBODIMENTS OF THE INVENTION

Now, one embodiment of this invention will be described with reference to FIGS. 4 and 5.

Figure 1:
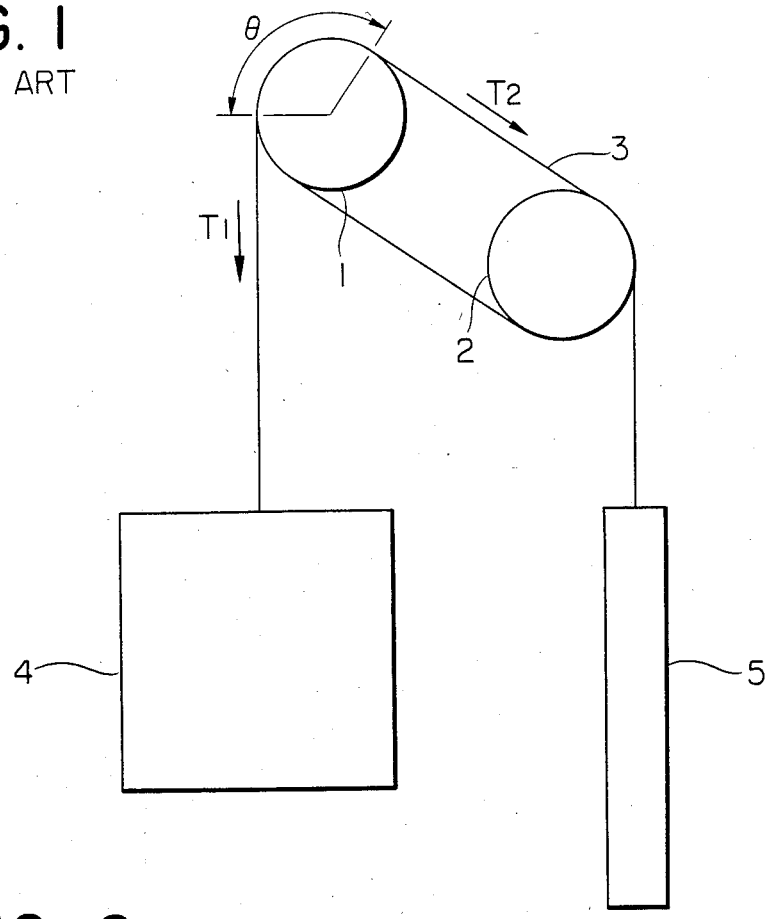
FIG. 1 PRIOR ART
FIG. 1 is a schematic constructional view of an elevator.
Figure 2:
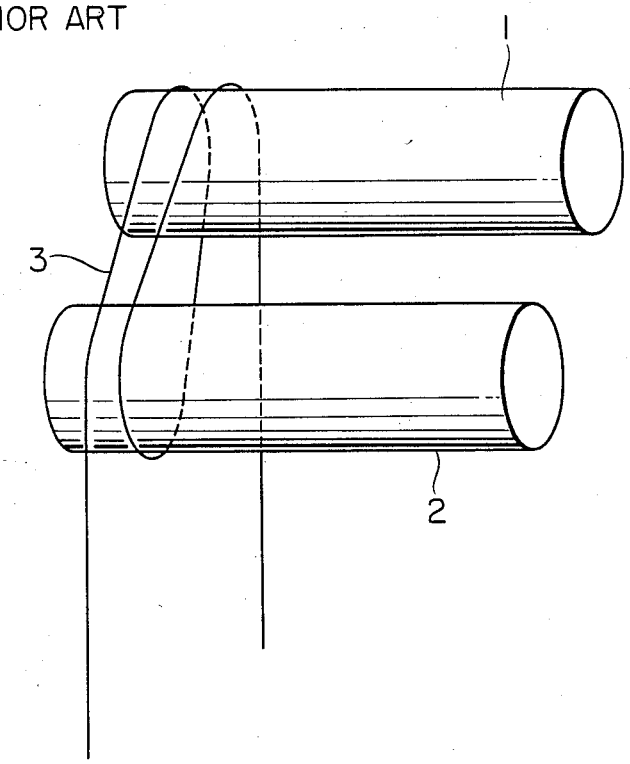
FIG. 2 PRIOR ART
FIG. 2 is a perspective view showing the state in which a main rope is wound around a driving sheave and a deflector wheel in a prior-art traction type elevator.
Figure 3:
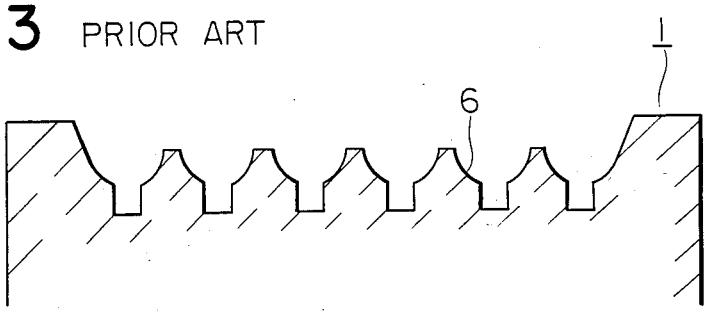
FIG. 3 PRIOR ART
FIG. 3 is a partial vertical sectional view the rope race the driving sheave in the prior showing art.
Figure 4:
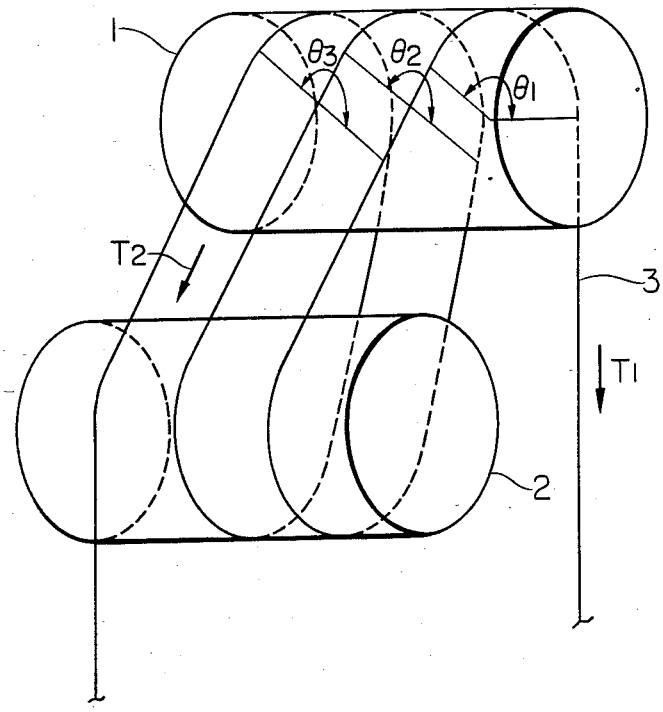
FIG. 4 is a view corresponding to FIG. 2, of a traction type elevator according to an embodiment of this invention.
Figure 5:
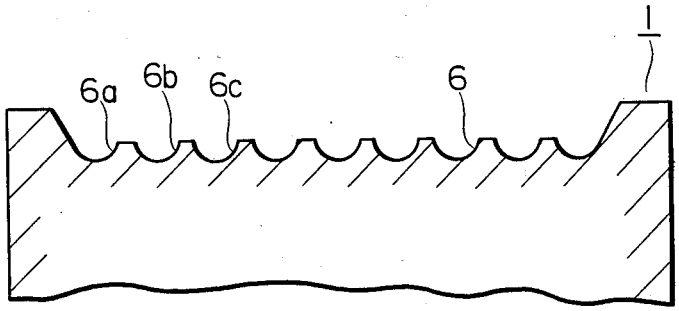
FIG. 5 is a view corresponding to FIG. 3, of the elevator in FIG. 4.

In FIGS. 4 and 5, the same symbols as in FIGS. 1 to 3 indicate identical or corresponding portions. As shown in FIG. 4, this embodiment is such that the main rope 3 is wound by three turns around the driving sheave 1 and the deflector wheel 2 which is arranged obliquely below the driving sheave. In addition, as shown in FIG. 5, the rope race 6 formed in the outer peripheral surface of the sheave 1 is formed into a sectional shape of circular arcs which are substantially semicircles each having a diameter nearly equal to the outside diameter of the main rope 3. The main rope 3 is held in engagement with the rope race 6. The construction of this embodiment other than stated above is similar to that of the system illustrated in FIGS. 1 to 3. Although a plurality of main ropes 3 are usually used, only one is depicted.

According to this embodiment, the main rope 3 is wound around the sheave 1 and the deflector wheel 2 by three turns. Therefore, the winding angle $\theta$ of the main rope 3 widens, and the traction can be enhanced. In addition, although the number of times of bending of the main rope 3 becomes 1.5 times larger than in the prior art, the section of the rope race 6 is shaped into circular arcs so as to lower groove pressures. Therefore, the life of the main rope 3 and the sheave 1 can be prolonged, and the sectional shape of the rope race 6 in this embodiment achieves the effect of extending the life of the main rope to three times or more when compared with the sectional shape of the rope race in the prior art described above.

The relationship of this embodiment and the priorart system as to the traction and the other parameters are compared by the use of equation (2), and are listed in Table 1.

$$e^{\mu k_2 \theta} \geqq \frac{T_1}{T_2} = \frac{(W_1 + W)(1 + \alpha)}{W_2(1 - \alpha)} \quad (2)$$

where $W_1$: the weight of the cage, $W_2$: the weight of the balance weight, $\alpha$: an acceleration, W: a capacity.

TABLE 1

| Quantities | Embodiment (A) | Prior Art (B) | $\frac{(A)}{(B)} \times 100$ (%) |
|---|---|---|---|
| $\mu$ | 0.1 | 0.1 | 100% |
| $k_2$ | 1.2 | 1.3 | 92% |
| $\theta$ | 510° (8.90 rad) | 330° (5.76 rad) | 155% |
| $e^{\mu k_2 \theta}$ | 2.91 | 2.11 | 138% |

As understood from Table 1, the system of the embodiment enhances the traction by 38% over the priorart system. This enhancement has the effect that the empty weight of the cage can be reduced to ½ or less.

As described above, the traction type elevator system of this embodiment winds the main rope around the driving sheave and the deflector wheel by three turns and shapes the rope race of the sheave into circular arcs in cross section, thereby to bring forth the effects that the traction can be sharply enhanced and that the life of the main rope and the sheave can be prolonged.

Meanwhile, the setting of the traction in the traction system as in this embodiment is designed in consideration of a deceleration etc., necessary in a state of emergency, i.e., during an urgent braking operation for safely stopping the elevator car. Therefore, the set traction is designed for double or more the traction which is required during normal operation. As is well known, for traction type elevators, the tension of the main rope 3 varies along the sheave 1 and that minute slips occur therebetween. Regions where the minute slips develop are illustrated in FIGS. 6 and 7.

Figure 6:
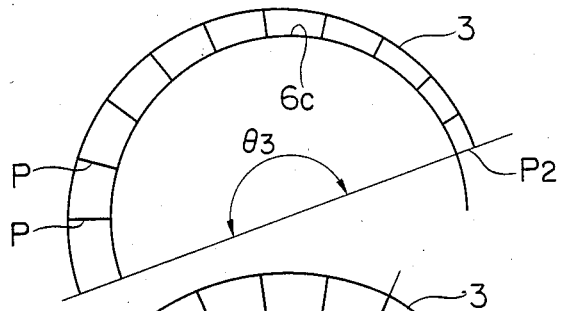
FIGS. 6(*a*)–6(*c*) and FIGS. 7(*a*)–7(*e*) are diagrams of the contact pressure distributions of the grooves of a driving sheave.
Figure 6:
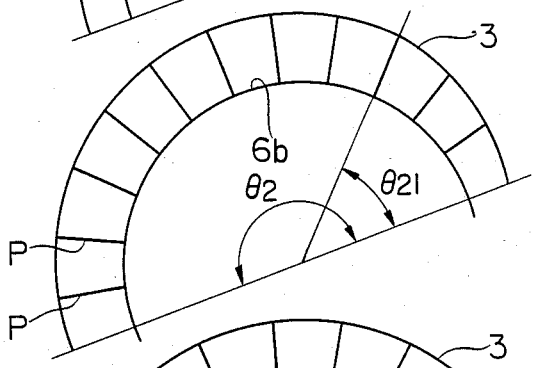
Figure 6:
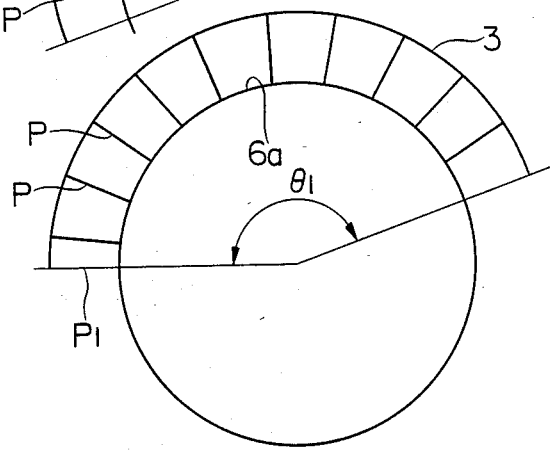
Figure 7:
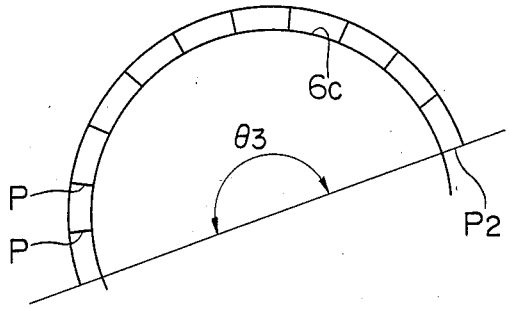
Figure 7:
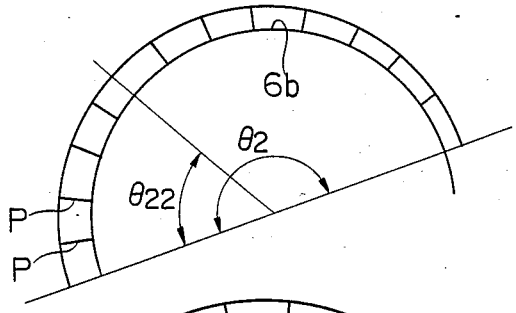
Figure 7:
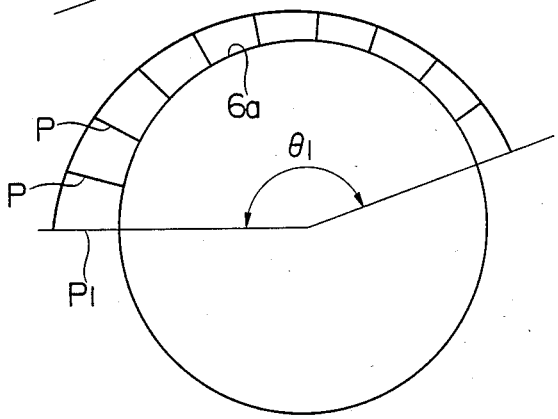

FIG. 6 shows the distributions of the contact pressures of the main rope 3 on the grooves 6a–6c of the sheave 1 during the ascent of the cage 4, while FIG. 7 shows the distributions during the descent of the cage 4. In both the figures, (a)–(c) correspond to the third groove 6c, the second groove 6b and the first groove 6a, respectively. Lines P radially indicate the aformentioned contact pressures, and symbol $P_1$ denotes the contact pressure on the cage 4 side, while symbol $P_2$ denotes the contact pressure on the balance weight 5 side.

The regions where the minute slips of the main rope 3 arise are the points where the contact pressure P change. In the first groove 6a in FIG. 6, the contact pressure P does not change over the whole range of a winding angle $\theta_1$. In the second groove 6b, the contact pressure changes over an angle $\theta_{21}$ on the balance weight 5 side within a winding angle $\theta_2$, and it does not change in the remaining part thereof. In the third groove 6c, the contact pressure changes over the whole range of a winding angle $\theta_3$. The minute slips accordingly arise on the exit side of the main rope 3, namely, in the portions of the rope along the winding angle $\theta_{21}$ and $\theta_3$ when the cage 4 ascends. On the other hand, in the third groove 6c in FIG. 7, the contact pressure P does not change over the whole range of the winding angle $\theta_3$, in the second groove 6b, the contact pressure changes only over an angle $\theta_{22}$ on the cage 4 side within the winding angle $\theta_2$, and in the first groove 6a, the contact pressure changes over the whole range of the winding angle $\theta_1$. The minute slips, accordingly, arise on the exit side of the main rope 3, namely, in the parts of the winding angle $\theta_1$ and the winding angle $\theta_{22}$ when the cage 4 descends.

The race 6 of the sheave 1 wears away due to these minute slips of the main rope 3. As stated before, the traction required during ordinary operation for the wound angle of the main rope 3 is half of the set value or less. Thus, the amounts of slips of the main rope 3 relative to the respective grooves 6a–6c differ. Since the grooves 6a–6c wear away in proportion to the amounts of slips, the life of the main rope 3 and the sheave 1 are shortened, and moreover, the pleasant ride of the cage 4 is diminished.

An embodiment for solving such problems will be described below.

Figure 8:
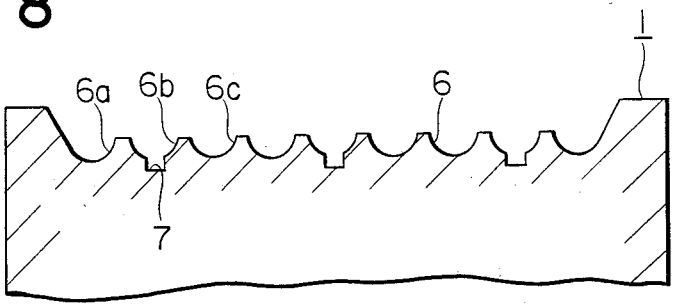
FIG. 8 is a sectional view of the groove portion of a driving sheave showing another embodiment of the traction type elevator according to this invention.
Figure 9:
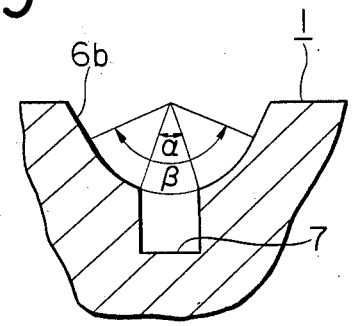
FIG. 9 is an enlarged view of a second groove in FIG. 8.

In FIGS. 8 and 9, numeral 7 designates an undercut portion which is concavely formed along the bottom of each second groove 6b and which is not formed in the first groove 6a or the third groove 6c. Except for this change, the embodiment is the same as in FIG. 4.

More specifically, the second groove 6b has a shape in which it exerts a greater frictional force on the main rope 3 than the first groove 6a or the third groove 6c. As a result, the second groove 6b on which the main rope 3 slips less wears away equally to the first groove 6a or the third groove 6c on which the main rope slips more. This will be explained as to an example employing concrete numerical values. The traction ability $e^{\mu k_2 \theta}$ is expressed by the following equation (1):

For $T_1 > T_2$, $$e^{\mu k_2 \theta} = (T_1/T_2) \quad (3)$$

$$\theta = \frac{\ln \frac{T_1}{T_2}}{\mu k_2}$$

Here, e: the base of the natural logarithm, $\mu$:the friction factor between the race 6 of the sheave and the main rope 3, $k_2$ the shape coefficient of the race 6, $\theta$: the winding angle of the main rope 3 around the driving sheave 1, $T_1$: the tension of the main rope 3 on the side of the cage 4, $T_2$ the tension of the main rope 3 on the side of the balance weight 5. Let it now be supposed that the winding angles of the main rope 3 round the respective grooves 6a–6c are:

$\theta_1 = 160°$, $\theta_2 = 180°$, $\theta_3 = 180°$, and that $T_1/T_2 = 1.6$ holds. Then, the winding angle $\theta$ of the main rope 3 which is determined by the traction necessary during ordinary operation becomes $\theta = 225°$ assuming $\nu = 0.1$ and $k_2 = 1.2$. Thus, those regions of the respective grooves 6a–6c where the slips of the main rope 3 arise become as follows:

| | First groove 6a | Second groove 6b | Third groove 6c | Total |
|---|---|---|---|---|
| Ascent mode | 0 | $\theta_{21} = 45°$ | $\theta_3 = 180°$ | 225° |
| Descent mode | $\theta_1 = 160°$ | $\theta_{22} = 65°$ | 0 | 225° |

Accordingly, the totals of those regions of the respective grooves 6a–6c where the slips of the main rope 3 arise and the ratios of the wear amounts of the respective grooves 6a–6c (with the wear amount of th third groove 6c set at 100% become as follows:

| | First groove 6a | Second groove 6b | Third groove 6c |
|---|---|---|---|
| Total of the slip developing regions | 160° | 110° | 180° |
| Wear amount of the groove | 90% | 61% | 100% |

As seen from this, the wear of the second groove 6b will not proceed as compared with that of the first groove 6a or the third groove 6c. Therefore, the contact pressure tween the main rope 3 and the race 6 needs to be raised by the component by which the main rope 3 slips less, and the second groove 6b is provided with the undercut portion 7 in contrast to the first groove 6a and the third groove 6c which are the circular grooves.

Here, the contact pressure between the main rope and the race 6 and the amount of wear of the groove are respectively indicated by the following equations (4) and (5):

$$P = k_2(T/dD) \quad (4)$$

where $$k_2 = \frac{8 \cos\alpha/2}{\beta - \alpha + \sin\beta - \sin\alpha}$$

Here,

P: the contact pressure between the main rope 3 and the race 6,

T: the tension of the main rope 3, d: the diameter of the main rope 3,

D: the diameter of the sheave 1, $k_2$: a contact pressure coefficient $\alpha$: an undercut angle (FIG. 9), $\beta$: the angle of contact of the main rope 3 with the race 6 (FIG. 9).

$$h = Z(PL/H) \quad (5)$$

Here, h: the amount of wear of the race 6,

Z a constant,

H: the hardness of the race 6,

L: the frictional distance between the main rope 3 and the race 6.

As apparent from equation (5), the amount of wear h is proportional to the product between the contact pressure P and the frictional distance L. In addition, the frictional distance L corresponds to the total of the slip developing regions (160°, 110°or 180°). Therefore, assuming the contact angle $\beta = 130°$ in the aforecited example, the amounts of wear h of the respective grooves 6a–6c become substantially equal when the groove 6b is provided with the undercut portion 7 having the undercut angle $\alpha = 40°$.

While the above embodiment has referred to the case where the main rope 3 is wound around the sheave 1 by three turns, this is not restrictive, but the invention is also applicable to a case of winding the main rope by four or more turns. In this case, the intermediate grooves other than the groove on which the main rope 3 is wound first and the groove on which it is wound last may have a shape affording more friction to the main rope 3, for example, may be formed with the undercut portions 7.

As set forth above, according to the second embodiment, the main rope is wound around the driving sheave and the deflector wheel of the elevator by at least three turns, and among the grooves of the sheave, those except the grooves on which the main rope is wound first and last are shaped so as to afford larger amounts of friction to the main rope than the amount of friction of the groove round which the main rope is wound first or last. Therefore, the contact pressure between the main rope and the groove can be raised by the component by which the main rope slips less, and the amounts of wear of the respective grooves of the sheave can be equalized.

Next, a third embodiment of this invention will be described with reference to the drawing.

Figure 10:
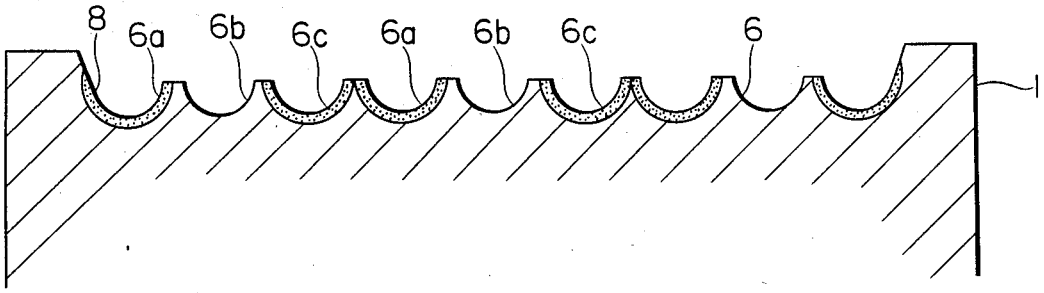
FIG. 10 is a sectional view of essential portions showing an example of a sheave in a third embodiment of the traction type elevator system according to this invention.

FIG. 10 shows an example of the sheave 1 for use in the traction type elevator system of this invention. Among the respective grooves with which the rope is held in engagement by the three-turn winding, the first and third grooves 6a and 6c have their peripheral surfaces formed with hardened layers 8 by heat-treating them. Thus, the hardness of the first and third grooves 6a, 6c is rendered higher than that of the second groove 6b.

In the embodiment based on Table 1, when the hardness of the second groove 6b is assumed 150 HB in terms of the Brinell hardness, the hardness of the first and third grooves needs to be rendered approximately 210 HB which is about 1.4 times.

When among the grooves of the sheave 1 with which the rope is held in engagement, the first and third grooves are rendered higher in bardness than the second groove as described above, the amount of wear of the first or third groove having greater rope slips is equalized to that of the second groove having less rope slip. Owing to the equalized amounts of wear of the respective grooves, the life of the rope and the sheave are enhanced, and the pleasant ride of the elevator is not diminished.

Figure 11:
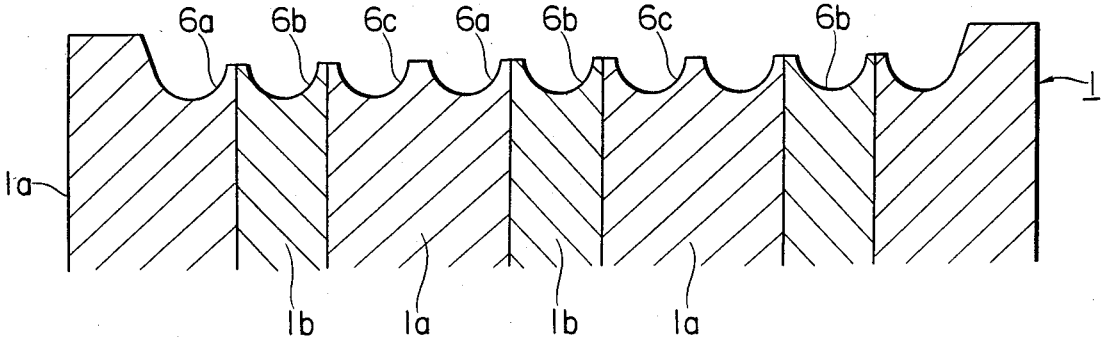
FIG. 11 is a sectional view of the essential port of a sheave showing a fourth embodiment of this invention.

FIG. 11 shows a fourth embodiment of this invention. Referring to the Fig., the sheave 1 includes a member 1a in which the first or/and third groove(s) 6a, 6c is/are formed and a member 1b in which the second groove 6b is formed, are made of materials of unequal hardnesses. The sheave 1 is constructed by stacking these members 1a, 1b in the axial direction thereof. The hardness of the member 1a is higher than that of the member 1b.

Even with the sheave of such split structure, the same effects as in the foregoing embodiment are attained.

As set forth above, according to the third or fourth embodiment, the first and third grooves having large amounts of rope slips are rendered higher in hardness than the second groove which has a small amount of rope slip. Therefore, even when the amounts of rope slips in the respective grooves of the sheave are unequal, the amounts of wear of the respective grooves can be equalized. Accordingly, the life of the rope and the sheave are enhanced, and the pleasant ride of the elevator is not diminished.

What is claimed is:

1. In a traction type elevator system wherein a cage and a balance weight are respectively suspended from either end of a main rope which is wound around a driving sheave and a deflector wheel, said main rope being wound around said sheave and said deflector wheel by at least three turns; means in an outer peripheral surface of said sheave with which said main rope is held in engagement forming grooves for said main rope in the shape of circular arcs in section, all of said grooves except said grooves around which said main rope is wound first and last being formed with undercut portions in bottom parts thereof so as to provide greater friction between said main rope and said grooves having an undercut portion than between said main rope and said first and last grooves.

2. A traction type elevator system according to claim 1, wherein a contact angle of said main rope to said each groove provided with said undercut portion is 130°, and an undercut angle of said undercut portion is 40°.

3. In a traction type elevator system wherein a cage and a balance weight are respectively suspended from either end of a main rope which is wound around a driving sheave and a delector wheel, said main rope being wound around said sheave and said deflector wheel by at least three turns; means in an outer peripheral surface of said sheave with which said main rope is held in engagement forming grooves for said main rope in the shape of circular arcs in section, said grooves around which said main rope is wound first and last being higher in hardness than the other grooves.

4. A traction type elevator system according to claim 3, wherein a peripheral surface of each of said grooves around which said main rope is wound first and last is formed with a hardened layer.

5. A traction type elevator system according to claim 4, wherein said hardened layer is a heat-treated layer formed in such a way that the peripheral surface of said each groove to have the higher hardness is heat-treated.

6. A traction type elevator system according to claim 3, wherein the hardness of said each groove to have the higher hardness is about 1.4 times that of the other grooves.

7. A traction type elevator system according to claim 6, wherein the hardness of said each groove to have the higher hardness is about 210 HB in terms of the Brinell hardness, and that of the other grooves is 150 HB.

8. A traction type elevator system according to claim 3 wherein the grooves to have the higher hardness and the other grooves are made of members of materials of unequal hardnesses, and each of these members is a disc-shaped member which has at least one groove at its outer periphery, and said members are alternately stacked to form said sheave.

* * * * *